US006860798B2

(12) United States Patent
Castor

(10) Patent No.: US 6,860,798 B2
(45) Date of Patent: Mar. 1, 2005

(54) CARRIER ASSEMBLIES, PLANARIZING APPARATUSES INCLUDING CARRIER ASSEMBLIES, AND METHODS FOR PLANARIZING MICRO-DEVICE WORKPIECES

(75) Inventor: Terry Castor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 48 days.

(21) Appl. No.: 10/215,512

(22) Filed: Aug. 8, 2002

(65) Prior Publication Data

US 2004/0029502 A1 Feb. 12, 2004

(51) Int. Cl.[7] ..... B24B 7/00
(52) U.S. Cl. ..... 451/288; 451/41; 451/390
(58) Field of Search ..... 451/41, 285–290, 451/390

(56) References Cited

U.S. PATENT DOCUMENTS

| | | | | |
|---|---|---|---|---|
| 4,070,133 A | * | 1/1978 | McCormick | 417/38 |
| 4,924,860 A | * | 5/1990 | Larsen et al. | 128/205.12 |
| 5,069,002 A | | 12/1991 | Sandhu et al. | |
| 5,081,796 A | | 1/1992 | Schultz | |
| 5,113,655 A | * | 5/1992 | Schumacher et al. | 60/408 |
| 5,232,875 A | | 8/1993 | Tuttle et al. | |
| 5,234,867 A | | 8/1993 | Schultz et al. | |
| 5,240,552 A | | 8/1993 | Yu et al. | |
| 5,244,534 A | | 9/1993 | Yu et al. | |
| 5,245,790 A | | 9/1993 | Jerbic | |
| 5,245,796 A | | 9/1993 | Miller et al. | |
| RE34,425 E | | 11/1993 | Schultz | |
| 5,421,769 A | | 6/1995 | Schultz et al. | |
| 5,433,651 A | | 7/1995 | Lustig et al. | |
| 5,449,314 A | | 9/1995 | Meikle et al. | |
| 5,486,129 A | | 1/1996 | Sandhu et al. | |
| 5,514,245 A | | 5/1996 | Doan et al. | |
| 5,533,924 A | | 7/1996 | Stroupe et al. | |
| 5,540,810 A | | 7/1996 | Sandhu et al. | |
| 5,618,381 A | | 4/1997 | Doan et al. | |

(List continued on next page.)

OTHER PUBLICATIONS

Seiichi Kondo, Noriyuki Sakuma, Yoshio Homma, Yasushi Goto, Naofumi Ohashi, Hizuru Yamaguchi, and Nobuo Owada, "Abrasive–Free Polishing for Copper Damascene Interconnection", *Journal of the lectrochemical Society*, 147 (10) pp. 3907–3913 (2000).

*Primary Examiner*—Joseph J. Hail, III
*Assistant Examiner*—Anthony Ojini
(74) *Attorney, Agent, or Firm*—Perkins Coie LLP

(57) ABSTRACT

The present invention is directed toward carrier assemblies, planarizing machines with carrier assemblies, and methods for mechanical and/or chemical-mechanical planarization of micro-device workpieces. In one embodiment, a carrier assembly for holding a microelectronic workpiece comprises a head, a backing assembly in the head, and a barrier. The head includes a chamber, a pneumatic line in fluid communication with the chamber through which a pneumatic fluid passes, and a retaining member defining a perimeter portion of a workpiece cavity. The backing assembly is positioned in the head, and the backing assembly can include a plate in the chamber and a diaphragm on one side of the plate. The diaphragm defines a backside portion of the workpiece cavity. The barrier is positioned in the chamber and/or the pneumatic line. The barrier is configured to inhibit contaminants from back-flowing into at least a portion of the pneumatic line. The barrier, for example, can be a membrane or a filter that inhibits or prevents matter such as particulates and/or fluids from passing along at least a portion of the pneumatic line. As a result, when the diaphragm rips, the barrier prevents the planarizing solution from fouling the pneumatic line and/or a rotary coupling.

58 Claims, 7 Drawing Sheets

U.S. PATENT DOCUMENTS 5,643,060 A 7/1997 Sandhu et al.
5,658,183 A 8/1997 Sandhu et al.
5,658,190 A 8/1997 Wright et al.
5,664,988 A 9/1997 Stroupe et al.
5,679,065 A 10/1997 Henderson
5,702,292 A 12/1997 Brunelli et al.
5,730,642 A 3/1998 Sandhu et al.
5,747,386 A 5/1998 Moore
5,792,709 A 8/1998 Robinson et al.
5,795,495 A 8/1998 Meikle
5,807,165 A 9/1998 Uzoh et al.
5,830,806 A 11/1998 Hudson et al.
5,851,135 A 12/1998 Sandhu et al.
5,868,896 A 2/1999 Robinson et al.
5,882,248 A 3/1999 Wright et al.
5,893,754 A 4/1999 Robinson et al.
5,895,550 A 4/1999 Andeas
5,930,699 A 7/1999 Bhatia
5,934,980 A 8/1999 Koos et al.
5,945,347 A 8/1999 Wright
5,954,912 A 9/1999 Moore
5,967,030 A 10/1999 Blalock
5,972,792 A 10/1999 Hudson
5,980,363 A 11/1999 Meikle et al.
5,981,396 A 11/1999 Robinson et al.
5,994,224 A 11/1999 Sandhu et al.
5,997,384 A 12/1999 Blalock
6,039,633 A 3/2000 Chopra
6,040,245 A 3/2000 Sandhu et al.
6,054,015 A 4/2000 Brunelli et al.
6,066,030 A 5/2000 Uzoh
6,074,286 A 6/2000 Ball
6,083,085 A 7/2000 Lankford
6,110,820 A 8/2000 Sandhu et al.
6,116,988 A 9/2000 Ball
6,120,354 A 9/2000 Koos et al.
6,135,856 A 10/2000 Tjaden et al.
6,139,402 A 10/2000 Moore
6,143,123 A 11/2000 Robinson et al.
6,143,155 A 11/2000 Adams et al.
6,152,808 A 11/2000 Moore
6,176,992 B1 1/2001 Talieh
6,180,525 B1 1/2001 Morgan
6,187,681 B1 2/2001 Moore
6,191,037 B1 2/2001 Robinson et al.
6,193,588 B1 2/2001 Carlson
6,200,901 B1 3/2001 Hudson et al.
6,203,404 B1 3/2001 Joslyn et al.
6,203,413 B1 3/2001 Skrovan
6,206,756 B1 3/2001 Chopra et al.
6,210,257 B1 4/2001 Carlson
6,213,845 B1 4/2001 Elledge
6,218,316 B1 4/2001 Marsh
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,250,994 B1 6/2001 Chopra et al.
6,251,785 B1 6/2001 Wright
6,261,151 B1 7/2001 Sandhu et al.
6,261,163 B1 7/2001 Walker et al.
6,267,650 B1 7/2001 Hembree
6,273,786 B1 8/2001 Chopra et al.
6,273,796 B1 8/2001 Moore
6,276,996 B1 8/2001 Chopra
6,284,660 B1 9/2001 Doan
6,306,012 B1 10/2001 Sabde
6,306,014 B1 10/2001 Walker et al.
6,306,768 B1 10/2001 Klein
6,312,558 B2 11/2001 Moore
6,328,632 B1 12/2001 Chopra
6,331,488 B1 12/2001 Doan et al.
6,350,180 B2 2/2002 Southwick
6,350,691 B1 2/2002 Lankford
6,352,466 B1 3/2002 Moore
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,417 B2 3/2002 Walker et al.
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,376,381 B1 4/2002 Sabde

* cited by examiner

CARRIER ASSEMBLIES, PLANARIZING APPARATUSES INCLUDING CARRIER ASSEMBLIES, AND METHODS FOR PLANARIZING MICRO-DEVICE WORKPIECES

TECHNICAL FIELD

The present invention relates to carrier assemblies, planarizing machines with carrier assemblies, and methods for mechanical and/or chemical-mechanical planarization of micro-device workpieces.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier assembly 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier assembly 30 has a chuck or head 31 with a chamber 32, a retaining member 33 around a perimeter of the head 31, and a backing assembly in the chamber 32. The backing assembly includes a plate 34 and a diaphragm 35 on the exterior of the plate 34. The plate 34 can have a plurality of holes through which air can pass to act against the diaphragm. The carrier assembly 30 also has a pneumatic line 36 through a shaft 37, a rotary coupling 38 on the shaft 37, and an actuator assembly 39 (shown schematically) that rotates the shaft 37. The actuator assembly 39 translates or rotates the head 31 (arrows I and J respectively), and the rotary coupling 38 couples a pneumatic pump to the pneumatic line 36. In operation, a positive air pressure is applied to the plate 34 by pumping air into the chamber 32 via the pneumatic line 36, or a vacuum is applied by drawing air from the chamber 32 via the pneumatic line 36.

The planarizing pad 40 and a planarizing solution 44 define a planarizing medium that mechanically and/or chemically-mechanically removes material from the surface of a micro-device workpiece 12 in the head 31. The planarizing solution 44 may be a conventional CMP slurry with abrasive particles and chemicals that etch and/or oxidize the surface of the micro-device workpiece 12, or the planarizing solution 44 may be a "clean" non-abrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the micro-device workpiece 12 with the CMP machine 10, the carrier assembly 30 presses the workpiece 12 face-downward against the planarizing pad 40. More specifically, the carrier assembly 30 generally presses the micro-device workpiece 12 against the planarizing solution 44 on a planarizing surface 42 of the planarizing pad 40, and the platen 20 and/or the carrier assembly 30 moves to rub the workpiece 12 against the planarizing surface 42. As the micro-device workpiece 12 rubs against the planarizing surface 42, the planarizing medium removes material from the face of the workpiece 12.

The CMP process must consistently and accurately produce a uniformly planar surface on the workpiece 12 to enable precise fabrication of circuits and photo-patterns. A non-uniform surface can result, for example, when material is removed more quickly in one area than another during CMP processing. To compensate for the non-uniform removal of material, the carrier head shown in FIG. 1 can adjust the downforce by controlling the air pressure in the chamber 32. These carrier heads, however, have several drawbacks. For example, the diaphragm may rip during a planarizing cycle. When this occurs, the planarizing machine is programmed to apply a vacuum in the chamber 32 for holding the workpiece in the head 31. This causes the planarizing solution 44 to back-flow into the chamber 32 and up through the pneumatic line 36 to the rotary coupling 38. The planarizing solution fouls the rotary coupling 38, the pneumatic line 36, and the plate 34. The rotary coupling 38 may fail because of such fouling, which can cause unnecessary downtime for repairing the head 31. The fouling of the pneumatic line 36 and plate 34 may also make it difficult to control the distribution of backside pressure on the workpiece because the planarizing solution can obstruct the pneumatic line 36 or the holes in the plate 34. This often results in non-uniform surfaces on workpieces.

SUMMARY

The present invention is directed toward carrier assemblies, planarizing machines with carrier assemblies, and methods for mechanical and/or chemical-mechanical planarization of micro-device workpieces. In one embodiment, a carrier assembly for holding a microelectronic workpiece comprises a head, a backing assembly in the head, and a selective barrier. The head includes a chamber, a pneumatic line in fluid communication with the chamber through which a pneumatic fluid passes, and a retaining member defining a perimeter portion of a workpiece cavity. The backing assembly is positioned in the chamber of the head. The backing assembly, for example, can include a plate in the chamber and a diaphragm on one side of the plate. The diaphragm further defines a backside portion of the workpiece cavity. The selective barrier is positioned in at least one of the chamber and/or the pneumatic line, and the barrier is configured to inhibit contaminants from back-flowing into at least a portion of the pneumatic line. As a result, when the diaphragm rips, the barrier prevents the planarizing solution from fouling the pneumatic line and/or the rotary coupling.

The barrier can be located in the pneumatic line, the chamber, or at the plate. The barrier can comprise a material that allows air to pass through the pneumatic line while blocking liquids and solids from proceeding past the barrier. For example, in one embodiment the barrier can be a membrane that allows gases to pass through the pneumatic line. In other embodiments, the barrier can be a filter that removes solid particles from the fluid flow. The filter, for example, can be a mesh, random woven strands, a porous pad, or other type of porous material that prevents abrasive particles and other particulates in the planarizing solution from flowing past the filter. Certain embodiments of filters can allow liquid and air to flow through the pneumatic line. Suitable materials for the filter include nylon, ceramics, polyesters, compressed materials, sintered materials, nanotubes, and other materials.

Another embodiment of a carrier assembly for holding a microelectronic workpiece includes a head having a retaining member and a backing member positioned with respect to the retaining member to define a workpiece cavity for retaining the workpiece. The carrier assembly can also include a pneumatic assembly having a pneumatic line to transport a flow of gas relative to the backing member and a selective barrier in the pneumatic assembly that inhibits liquids and/or solids from back-flowing through at least a portion of the pneumatic line. In this embodiment, the carrier assembly can further comprise a chamber in the head, and the backing member can be positioned to enclose a portion of the chamber. The selective barrier can be located in the pneumatic line and/or the chamber, and the selective barrier can be a membrane, a filter, or another material. The selective barrier can be configured to allow air to pass through the pneumatic line, but prevent liquids and particulate matter from passing beyond the membrane.

Still additional embodiments are directed towards planarizing machines that have a table, a planarizing pad on the table, and a carrier assembly for holding a microelectronic workpiece as set forth above. These planarizing machines can be used to planarize a microelectronic workpiece by holding the workpiece in the head so that the backside of the workpiece contacts the diaphragm. The method continues by covering a portion of the planarizing surface of the polishing pad with a planarizing solution and then pressing the workpiece against the planarizing surface by providing a pressure against the workpiece via the pneumatic line and the diaphragm. The method can further include filtering liquids and/or solids on the backside of the diaphragm to inhibit or completely prevent them from flowing into the pneumatic line during a planarizing cycle.

DETAILED DESCRIPTION

The present invention is directed toward carrier assemblies, planarizing machines with carrier assemblies, and methods for mechanical and/or chemical-mechanical planarization of micro-device workpieces. As used herein, the term "micro-device workpiece" includes micromechanical and microelectronic workpieces, such as semiconductor wafers, field emission displays, and read-write heads. Several embodiments of the invention are described below with reference to FIGS. 2–7, but it will be appreciated that the invention can include other embodiments not shown in FIGS. 2–7. For example, aspects of the invention can include embodiments that do not have all of the features disclosed in FIGS. 2–7, or other embodiments can include features in addition to those disclosed in FIGS. 2–7. Additionally, the embodiments disclosed in FIGS. 2–7 are directed toward both rotary planarizing machines and web-format planarizing machines even though the following description focuses on rotary planarizing machines.

Figure 1:
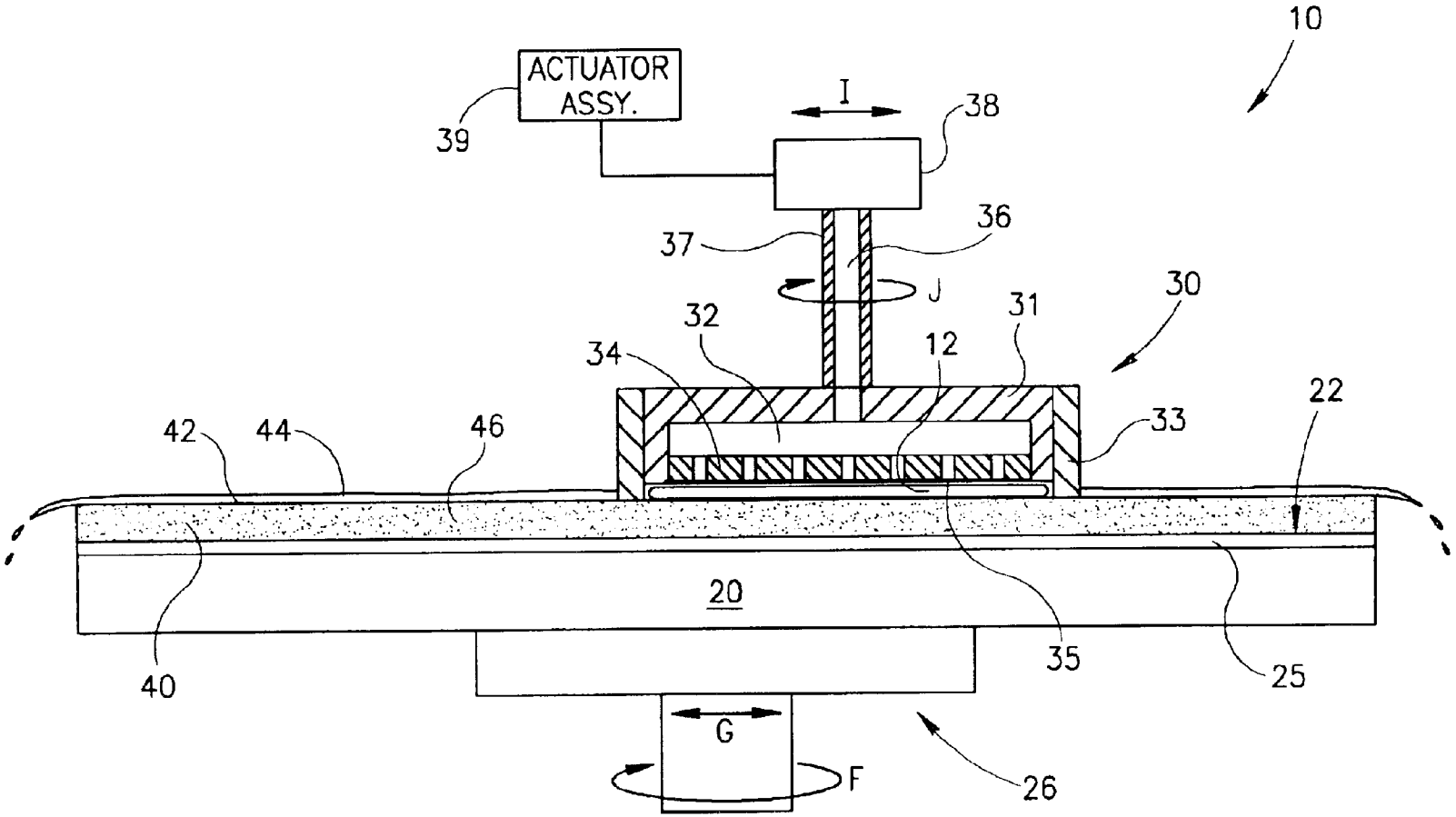
FIG.1 (PRIOR ART)
FIG. 1 is a schematic diagram of a rotary planarizing machine having a carrier assembly in accordance with the prior art.
Figure 2:
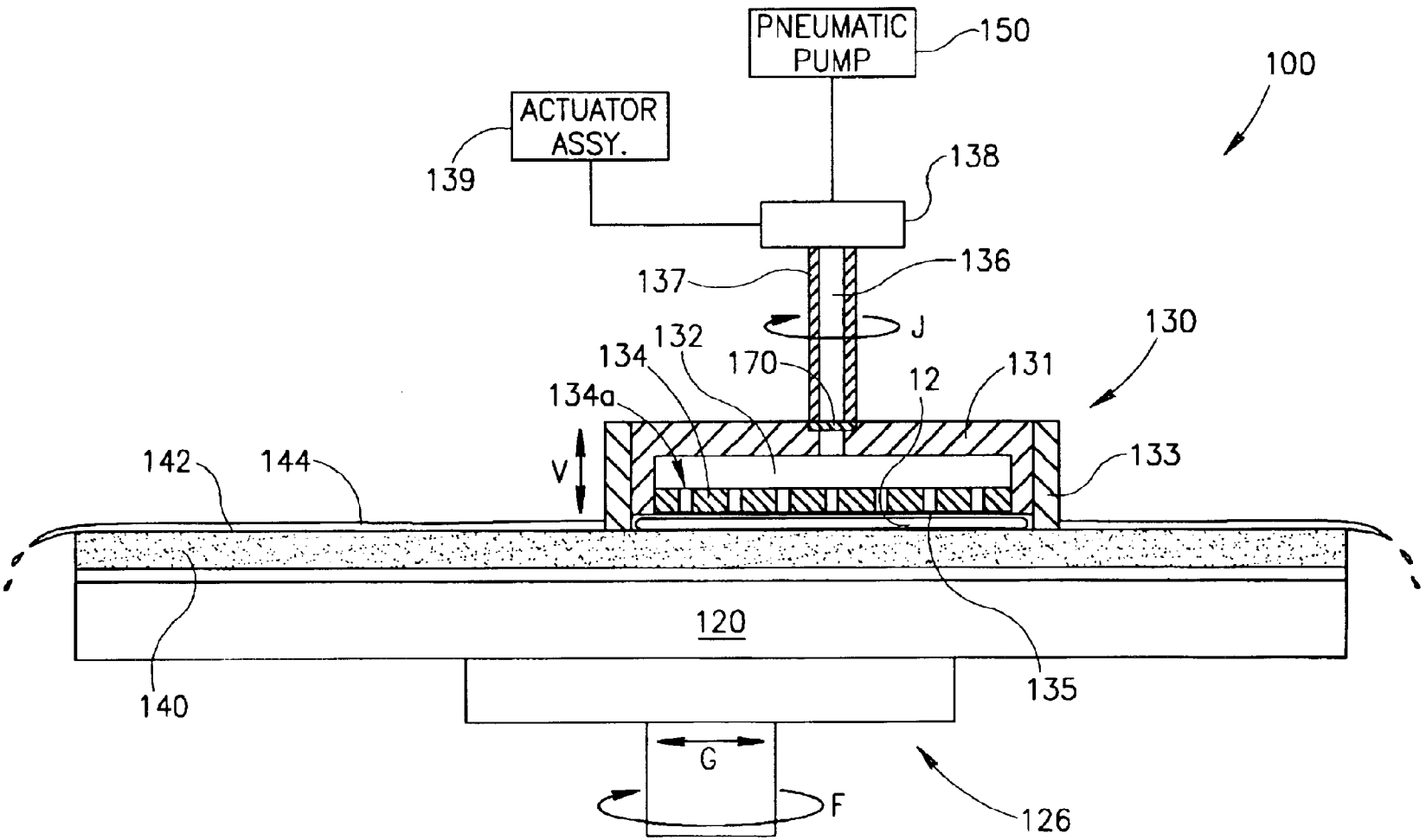
FIG. 2 is a schematic illustration of a planarizing machine in accordance with an embodiment of the invention.

FIG. 2 is a schematic illustration showing a planarizing machine 100 including a carrier assembly 130 in accordance with an embodiment of the invention. In this embodiment, the planarizing machine 100 also includes a table 120 that is driven by a table actuator 126. The table 120 can be a rotary platen that rotates or reciprocates as shown by arrows F and G, or it can be a fixed table. A polishing pad 140 having a planarizing surface 142 is attached to the table 120. The polishing pad 140 can be a non-abrasive pad or a fixed abrasive pad as described above. During a planarizing cycle, a planarizing solution 144 is deposited over the planarizing surface 142.

The carrier assembly 130 carries the workpiece 12 during the planarizing cycle. The carrier assembly 130, for example, can rotate and/or translate the workpiece 12 across the planarizing surface 142. In this embodiment, the carrier assembly includes a chuck or head 131 that has a chamber 132. The carrier assembly 130 also includes a retaining member 133, such as a retaining ring, that extends around at least a portion of the head 131. The retaining member 133 generally encircles the head 131, and it can move vertically with respect to the head 131 as shown by arrow V. The carrier assembly 130 also includes a backing assembly in the head 131. The backing assembly can include a diaphragm 135 that encloses the chamber 132. The retaining member 133 and the diaphragm 135 define a workpiece cavity in which the workpiece 12 is retained for loading and unloading during a planarizing cycle. In other embodiments, the backing assembly can further include a back-plate 134 on the backside of the diaphragm 135. The back-plate 134 is generally a flexible plate with openings 134*a*. The back-plate 134, for example, can be a lightweight material, and the openings 134*a* can be arranged in different patterns to allow air to flow through the back-plate 134 and act against the diaphragm 135. The back-plate 134 also can move up or down within the chamber 132.

The carrier assembly 130 also includes a pneumatic assembly that is carried by the head 131. The pneumatic assembly provides a positive pneumatic pressure to the back-plate 134 and the diaphragm 135 for adjusting the downforce against the workpiece 12, or the pneumatic assembly provides a suction that draws the diaphragm 135 into the openings 134*a* in the back-plate 134 for holding the workpiece 12 in the head 131. In this embodiment, the pneumatic assembly includes a pneumatic line 136 in a shaft 137, a rotary coupling 138, and a pneumatic pump 150 coupled to the line 136 via the rotary coupling 138. The pneumatic assembly accordingly transports a gas flow through the head 131 relative to the backing assembly.

The carrier assembly 130 can further include a selective barrier 170 in the pneumatic assembly that inhibits contaminants, such as slurry particles and/or liquids, from back-flowing through at least a portion of the pneumatic line 136. The selective barrier 170, for example, can be a filter or a membrane that is configured to prevent liquids and/or solid particles from back-flowing through the pneumatic line 136 and the rotary coupling 138. One suitable selective barrier allows air or other gases to pass through the pneumatic line 136, but prevents or at least inhibits liquids and solids from passing through the pneumatic line 136. Other suitable selective barriers allow gases and liquids to pass through the pneumatic line 136, but generally inhibit solids from fouling the line 136 and the rotary coupling 138. The selective barrier 170 can become clogged with particles to the extent that it also blocks liquids from back-flowing through the pneumatic system. Suitable selective barriers include filters or membranes made from nylon, ceramics, polyesters, sintered materials, carbon (e.g., pressed blocks or nano-tube structures), and other materials. It is expected that organic, hydrophilic membranes will work well for the barrier member. For example, nylon membranes are hydrophilic, strong, dimensionally stable, and easy to fabricate. Nylon membranes are also corrosion resistant, stable up to 180° C., and stable in high pH environments. One suitable material is a nylon mesh manufactured by Spectrum Laboratories under part number 145799, but many other materials can be used for the selective barrier.

As shown in FIG. 2, the selective barrier 170 can be between the head 131 and the shaft 137. In this embodiment, the selective barrier 170 is at a distal end of the shaft 137 to protect the pneumatic line 136 from being fouled by planarizing solution when the diaphragm 135 ruptures. The selective barrier 170 is preferably positioned within the head 131 to be close to the chamber 132. The barrier assembly 170 can also be positioned in the chamber 132 at the distal end of the pneumatic line 136 in other embodiments. Such positioning of the selective barrier 170 accordingly provides the most protection against the back-flow of planarizing solution through the pneumatic assembly. As explained below, however, the barrier 170 can be located in the line 136 or other parts of the carrier assembly 130.

The carrier assembly 130 shown in FIG. 2 operates to protect the pneumatic line 136 and the rotary coupling 138 from being fouled by planarizing solution when the diaphragm 135 tears or is otherwise damaged during a planarizing cycle. For example, typical planarizing machines provide a positive pneumatic pressure in the chamber 132 during a planarizing cycle, but reverse the positive pressure to create a vacuum in the chamber 132 when the diaphragm tears to avoid damaging the workpiece 12. Accordingly, the vacuum in the chamber 132 draws planarizing solution through the damaged portion of the diaphragm 135 and into the chamber 132. The selective barrier 170 allows air or other gases to pass through pneumatic line 136, but the selective barrier 170 prevents or otherwise inhibits planarizing solution from passing beyond the selective barrier 170. As a result, the planarizing machine 100 can continue to draw a vacuum against the backside of the workpiece 12 after the diaphragm 135 has been damaged, but it protects the pneumatic line 136 and the rotary coupling 138 from being fouled by the planarizing solution 144. Therefore, the particular embodiment of the carrier assembly 130 illustrated in FIG. 2 is expected to reduce the downtime and non-uniformities that can occur when the diaphragm 135 tears.

Figure 3:
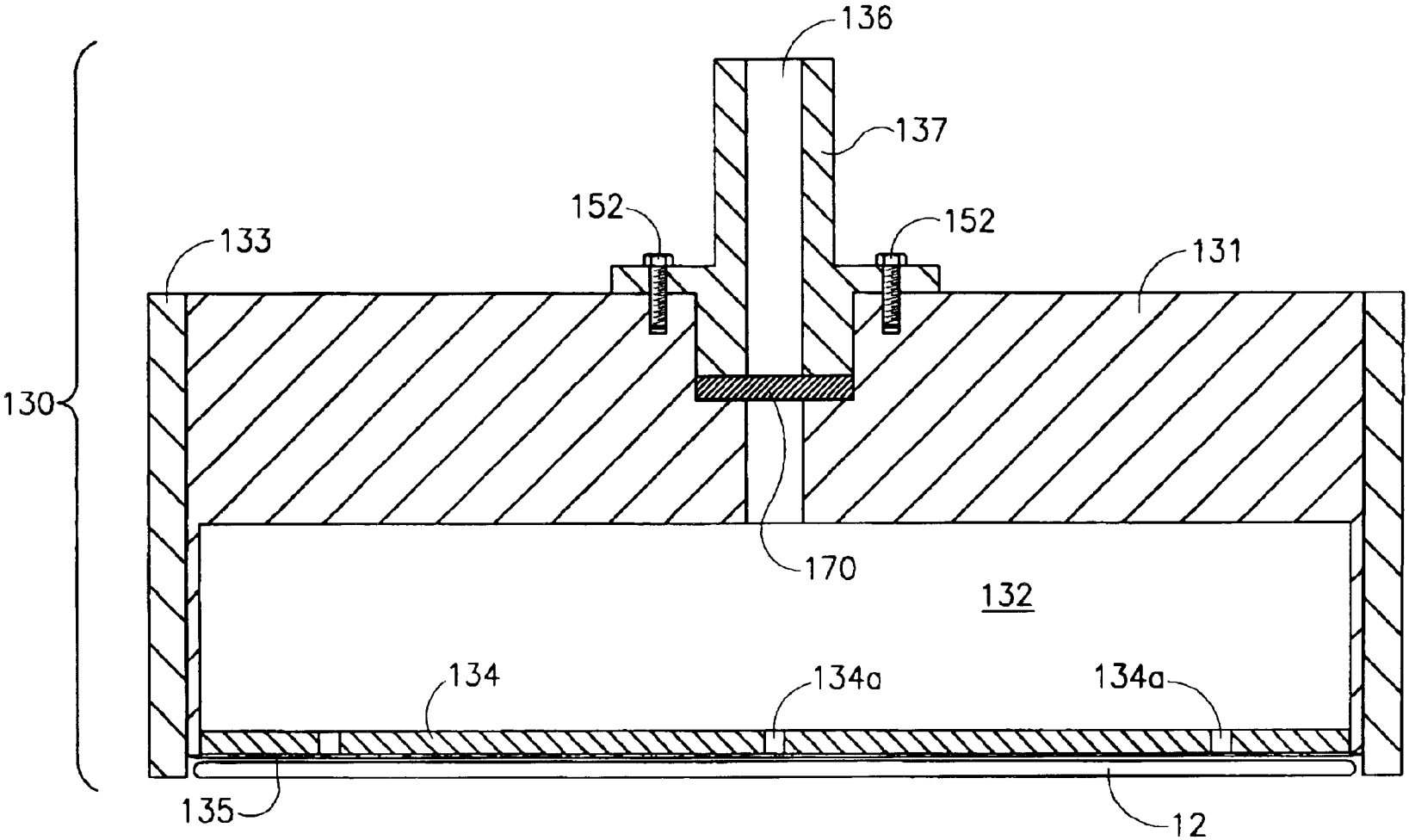
FIG. 3 is a cross-sectional view of a carrier assembly for use in a planarizing machine in accordance with one embodiment of the invention.

FIG. 3 is a cross-sectional view of a carrier assembly 130 illustrating an embodiment of the selective barrier 170 in greater detail. In this embodiment, the selective barrier 170 is removable to provide quick, easy cleaning of the carrier head 131 if the diaphragm 135 ruptures. The shaft 137 is coupled to the head 131 by a plurality of fasteners 152, such as bolts. The selective barrier 170 can be an annular filter or membrane that is clamped between the shaft 137 and the head 131 when the fasteners 152 are secured to the head 131. The selective barrier 170 can be replaced each time after the diaphragm 135 is damaged by simply removing the fasteners 152 to disconnect the shaft 137 from the head 131.

Figure 4:
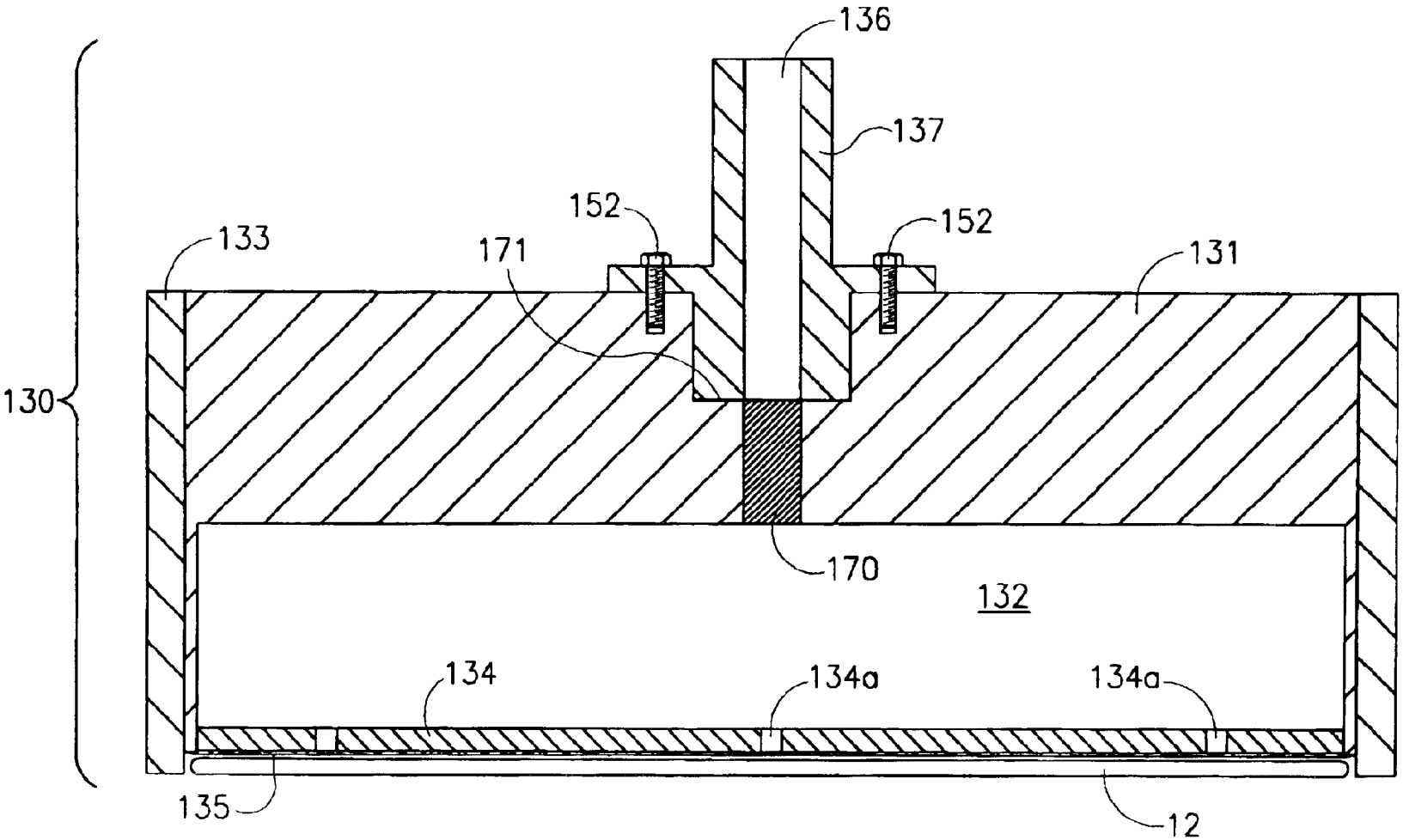
FIG. 4 is a cross-sectional view of a carrier assembly for use in a planarizing machine in accordance with another embodiment of the invention.
Figure 5:
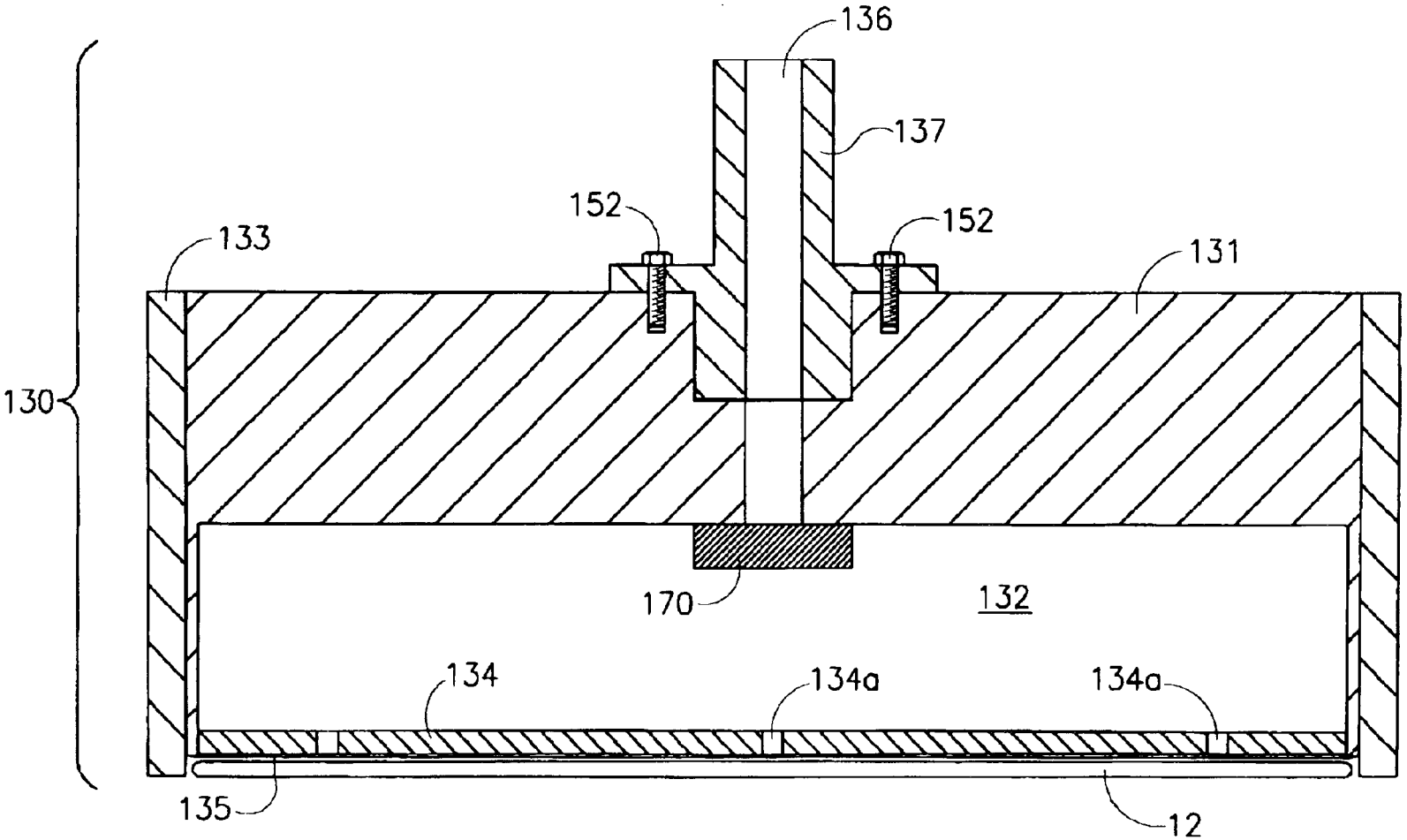
FIG. 5 is a cross-sectional view of a carrier assembly for use in a planarizing machine in accordance with another embodiment of the invention.
Figure 6:
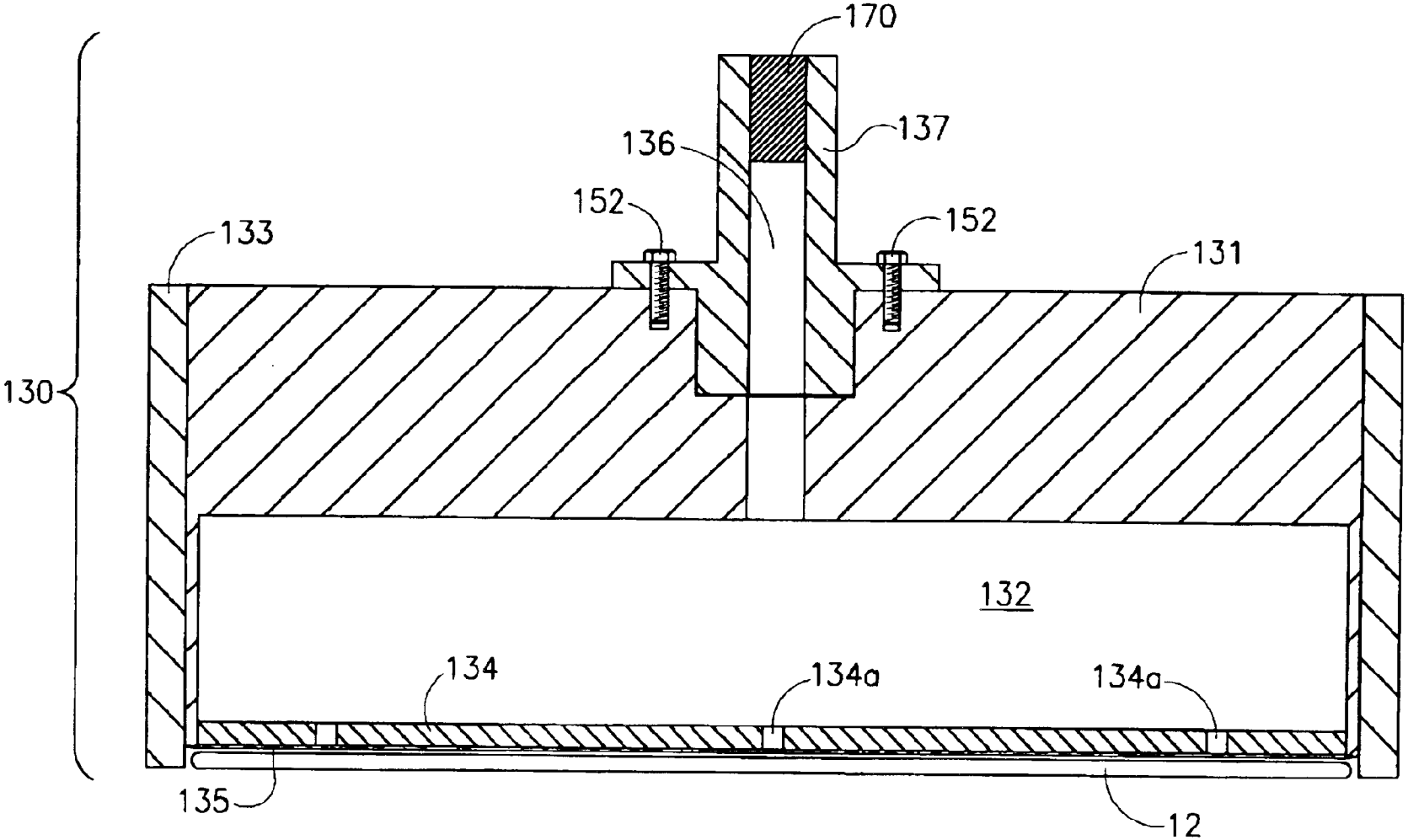
FIG. 6 is a cross-sectional view of a carrier assembly for use in a planarizing machine in accordance with another embodiment of the invention.
Figure 7:
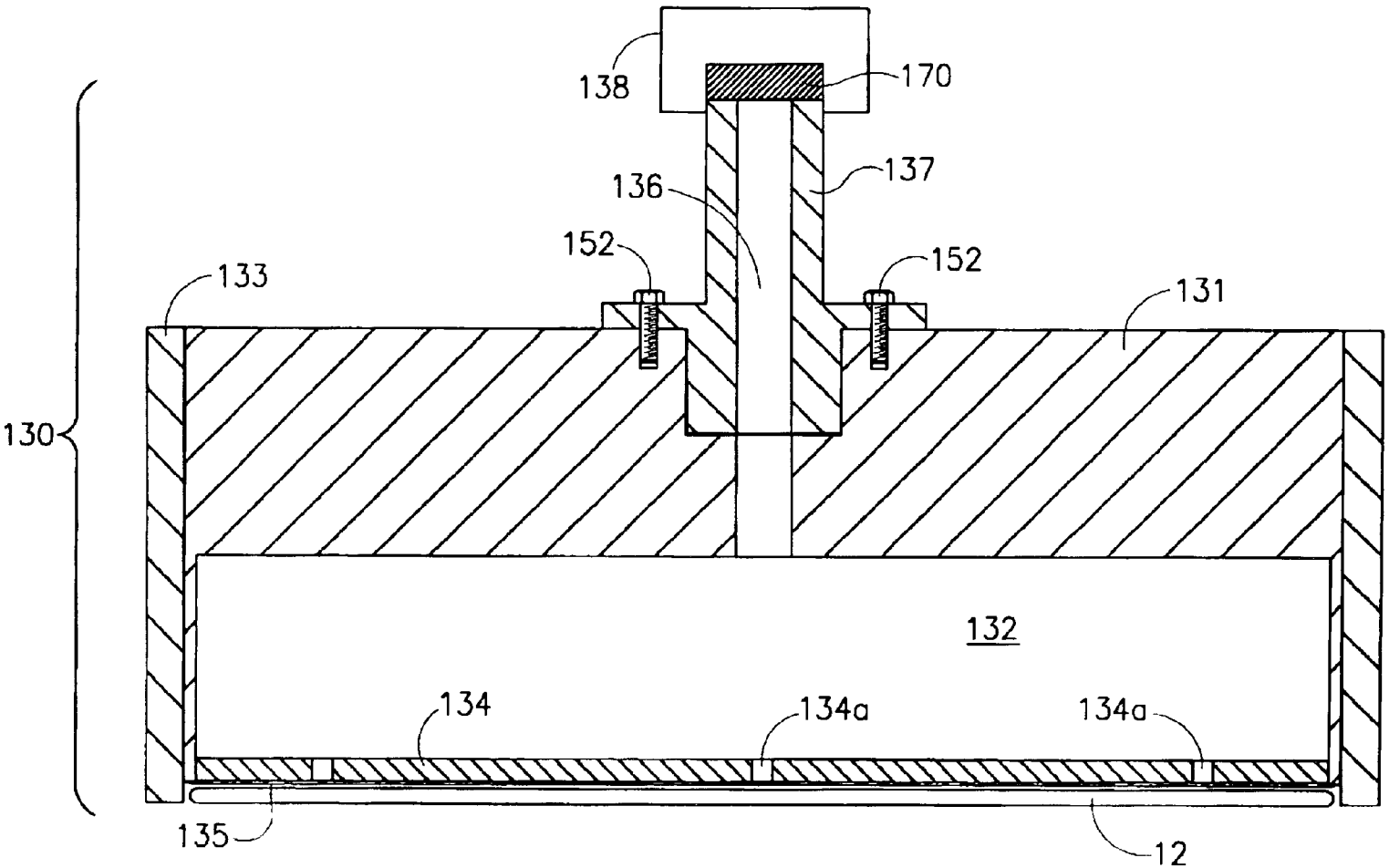
FIG. 7 is a cross-sectional view of a carrier assembly for use in a planarizing machine in accordance with another embodiment of the invention.

FIGS. 4–7 illustrate additional embodiments of carrier heads 130 in accordance with the invention. Referring to FIG. 4, the selective barrier 170 can be positioned directly in the distal portion of the pneumatic line 136. The selective barrier 170 shown in FIG. 4 further protects the pneumatic line 136 by being closer to the chamber 132 compared to the embodiment shown in FIGS. 2 and 3. The selective barrier 170 shown in FIG. 4 can have a flange 171 that is clamped between the distal end of the shaft 137 and the head 131. FIG. 5 illustrates another embodiment in which the selective barrier 170 is positioned in the chamber 132 at the distal end of the pneumatic line 136. The selective barrier 170 shown in FIG. 5 further protects the pneumatic line 136 because it inhibits fluids and/or solids from even entering the pneumatic line 136. FIG. 6 illustrates another embodiment in which the selective barrier 170 is positioned in the pneumatic line 136 along the shaft 137. FIG. 7 illustrates another embodiment in which the selective barrier 170 is positioned on a proximal end of the shaft 137 adjacent to the rotary coupling 138. The embodiments shown in FIGS. 6 and 7 protect the rotary coupling 138, but they do not protect the pneumatic line 136. The embodiments of the carrier assembly 130 shown in FIGS. 4–7 are expected to operate in substantially the same manner as the embodiment shown in FIG. 2.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A carrier assembly for holding a microelectronic workpiece in a mechanical or chemical-mechanical planarization machine, comprising:

a head including a chamber, a pneumatic line in fluid communication with the chamber through which a pneumatic flow passes, and a retaining member defining a perimeter of portion of a workpiece cavity;

a backing assembly in the head having a plate in the chamber and a diaphragm on one side of the plate, the diaphragm defining a backside portion of the workpiece cavity; and a filter in at least one of the chamber and the pneumatic line, the filter being configured to inhibit contaminants from back-flowing into at least a portion of the pneumatic line.

2. The carrier assembly of claim 1 wherein the filter is located in the pneumatic line.

3. The carrier assembly of claim 1 wherein the filter is located in the chamber.

4. The carrier assembly of claim 1 wherein the filter comprises a material that allows air to pass through the pneumatic line and blocks fluid from passing through the pneumatic line.

5. The carrier assembly of claim 1 wherein the filter comprises a nylon mesh.

6. The carrier assembly of claim 1 wherein the plate moves within the chamber and the plate has holes through which the pneumatic flow can exert a force against the diaphragm.

7. A carrier assembly for holding a microelectronic workpiece in a planarization machine, comprising:

a head including a retaining member that defines a perimeter portion of a workpiece cavity for containing a workpiece;

a backing assembly in the head, the backing assembly having a diaphragm within the retaining member to define a backside portion of the workpiece cavity;

a pneumatic assembly carried by the head, the pneumatic assembly having a pneumatic line to transport a gas flow through the head relative to the backing assembly; and a filter in the head at a location through which the gas flow passes.

8. The carrier assembly of claim 7, further comprising a chamber in the head and a back-plate in the chamber, and wherein the pneumatic line transports the gas flow to/from the chamber.

9. The carrier assembly of claim 8 wherein the filter is located in the pneumatic line.

10. The carrier assembly of claim 8 wherein the filter is located in the chamber.

11. The carrier assembly of claim 8 wherein the filter comprises a material that allows air to pass through the pneumatic line and blocks fluid from passing through the pneumatic line.

12. The carrier assembly of claim 8 wherein the filter comprises a nylon mesh.

13. The carrier assembly of claim 8 wherein the back-plate moves within the chamber and the back-plate has holes through which the pneumatic flow can exert a force against the diaphragm.

14. A carrier assembly for holding a microelectronic workpiece in a planarization machine, comprising:

a head having a retaining member and a backing member positioned with respect to the retaining member to define a workpiece cavity for retaining the workpiece;

a pneumatic assembly having a pneumatic line to transport a flow of gas relative to the backing member; and a selective barrier in the pneumatic assembly that at least inhibits mailer from back-flowing through at least a portion of the pneumatic line.

15. The carrier assembly of claim 14, further comprising a chamber in the head, wherein the backing member encloses a portion of the chamber, and wherein the pneumatic line transports the gas flow to/from the chamber.

16. The carrier assembly of claim 15 wherein the selective barrier is located in the pneumatic line.

17. The carrier assembly of claim 15 wherein the selective barrier is located in the chamber.

18. The carrier assembly of claim 15 wherein the selective barrier comprises a membrane that allows air to pass through the pneumatic line and inhibits fluid from passing through the pneumatic line.

19. The carrier assembly of claim 15 wherein the selective barrier is a filter.

20. The carrier assembly of claim 15 wherein the selective barrier comprises a nylon mesh.

21. The carrier assembly of claim 15 wherein the backing member comprises a plate that moves within the chamber and a diaphragm on an exterior side of the plate, and wherein the plate has holes through which the pneumatic flow can exert a force against the diaphragm.

22. A carrier assembly for holding a microelectronic workpiece in a planarization machine, comprising:

a head having a backing assembly with a diaphragm configured to contact a backside of a workpiece;

a pneumatic control assembly carried by the head, the pneumatic control assembly having a pneumatic line configured to transport a gas flow relative to the backing assembly; and a barrier means in the pressure control assembly that inhibit contaminants which have passed through an opening in the diaphragm from back-flowing through at least a portion of the pressure control assembly.

23. The carrier assembly of claim 22, further comprising a backside chamber in the head, wherein the diaphragm encloses a portion of the backside chamber and wherein the pneumatic line transports the gas flow to/from the backside chamber.

24. The carrier assembly of claim 23 wherein the barrier means is located in the pneumatic line.

25. The carrier assembly of claim 23 wherein the barrier means is located in the chamber.

26. The carrier assembly of claim 23 wherein the barrier means comprises a membrane that allows air to pass through the pneumatic line and blocks fluid from passing through the pneumatic line.

27. The carrier assembly of claim 23 wherein the barrier means comprises a filter.

28. The carrier assembly of claim 23 wherein the barrier means comprises nylon mesh.

29. The carrier assembly of claim 23 wherein the backing assembly further comprises a plate that moves within the chamber, and wherein the plate has holes through which the pneumatic flow can exert a force against the diaphragm.

30. A planarizing machine for mechanical and/or chemical-mechanical planarization of a workpiece, comprising:

a table;

a planarizing pad on the table;

a carrier assembly for holding a microelectronic workpiece, the carrier assembly comprising a head including a backside chamber, a pneumatic line in fluid communication with the chamber through which a pneumatic flow passes, and a retaining member defining a perimeter of portion of a workpiece cavity;

a backing assembly in the head having a plate in the chamber and a diaphragm on one side of the plate, the diaphragm defining a backside portion of the workpiece cavity; and a filter in at least one of the chamber and the pneumatic line, the filter being configured to inhibit contaminants from back-flowing into at least a portion of the pneumatic line.

31. The planarizing machine of claim 30 wherein the filter is located in the pneumatic line.

32. The planarizing machine of claim 30 wherein the filter is located in the chamber.

33. The planarizing machine of claim 30 wherein the filter comprises a material that allows air to pass through the pneumatic line and blocks fluid from passing through the pneumatic line.

34. The planarizing machine of claim 30 wherein the filter comprises a nylon mesh.

35. The planarizing machine of claim 30 wherein the plate moves within the chamber and the plate has holes through which the pneumatic flow can exert a force against the diaphragm.

36. A planarizing machine for mechanical and/or chemical-mechanical planarization of a workpiece, comprising:

a table;

a planarizing pad on the table;

a carrier assembly for holding a microelectronic workpiece, the carrier assembly including a head including a retaining member that defines a perimeter portion of a workpiece cavity for containing a workpiece;

a backing assembly in the head, the backing assembly having a back-plate and a diaphragm, the diaphragm being within the retaining member and on one side of the plate to define a backside portion of the workpiece cavity;

a pneumatic assembly carried by the head, the pneumatic assembly having a pneumatic line to transport a gas flow through the head relative to the backing assembly; and a filter in the head at a location through which the gas flow passes.

37. The carrier assembly of claim 36, further comprising a chamber in the head and a back-plate in the chamber, and wherein the pneumatic line transports the gas flow to/from the chamber.

38. The carrier assembly of claim 37 wherein the filter is located in the pneumatic line.

39. The carrier assembly of claim 37 wherein the filter is located in the chamber.

40. The carrier assembly of claim 37 wherein the filter comprises a material that allows air to pass through the pneumatic line and blocks fluid from passing through the pneumatic line.

41. The carrier assembly of claim 37 wherein the filter comprises a nylon mesh.

42. The carrier assembly of claim 37 wherein the back-plate moves within the chamber and the back-plate has holes through which the pneumatic flow can exert a force against the diaphragm.

43. A planarizing machine for mechanical and/or chemical-mechanical planarization of a workpiece, comprising:

a table;

a planarizing pad on the table;

a carrier assembly for holding a microelectronic workpiece, the carrier assembly comprising a head having a retaining member and a backing member positioned with respect to the retaining member to define a workpiece cavity for retaining the workpiece;

a pneumatic assembly having a pneumatic line to transport a flow of gas relative to the backing member; and a selective barrier in the pneumatic assembly that at least inhibits matter from back-flowing through at least a portion of the pneumatic line.

44. The carrier assembly of claim 43, further comprising a chamber in the heads wherein the backing member encloses a portion of the chamber, and wherein the pneumatic line transports the gas flow to/from the chamber.

45. The carrier assembly of claim 44 wherein the selective barrier is located in the pneumatic line.

46. The carrier assembly of claim 44 wherein the selective barrier is located in the chamber.

47. The carrier assembly of claim 44 wherein the selective barrier comprises a membrane that allows air to pass through the pneumatic line and inhibits fluid from passing through the pneumatic line.

48. The carrier assembly of claim 44 wherein the selective barrier comprises a filter.

49. The carrier assembly of claim 44 wherein the selective barrier comprises a nylon mesh.

50. The carrier assembly of claim 44 wherein the backing member comprises a plate that moves within the chamber and a diaphragm on an exterior side of the plate, and wherein the plate has holes through which the pneumatic flow can exert a force against the diaphragm.

51. A planarizing machine for mechanical and/or chemical-mechanical planarization of a workpiece, comprising:

a table;

a planarizing pad on the table;

a carrier assembly for holding a microelectronic workpiece, the carrier assembly comprising a head having a backing assembly with a diaphragm configured to contact a backside of a workpiece;

a pneumatic control assembly carried by the head, the pneumatic control assembly having a pneumatic line configured to transport a gas flow relative to the backing assembly; and a selective barrier in the pressure control assembly to inhibit contaminants from back-flowing through at least a portion of the pressure control assembly.

52. The carrier assembly of claim 51, further comprising a backside chamber in the head, wherein the diaphragm encloses a portion of the backside chamber, and wherein the pneumatic line transports the gas flow to/from the backside chamber.

53. The carrier assembly of claim 52 wherein the selective barrier is located in the pneumatic line.

54. The carrier assembly of claim 52 wherein the selective barrier is located in the chamber.

55. The carrier assembly of claim 52 wherein the selective barrier comprises a membrane that allows air to pass through the pneumatic line and inhibits fluid from passing through the pneumatic line.

56. The carrier assembly of claim 52 wherein the selective barrier comprises a filter.

57. The carrier assembly of claim 52 wherein the selective barrier comprises a nylon mesh.

58. The carrier assembly of claim 52 wherein the backing assembly further comprises a plate that moves within the chamber, and wherein the plate has holes through which the pneumatic flow can exert a force against the diaphragm.

* * * * *

UNITED STATES PATENT AND TRADEMARK OFFICE

CERTIFICATE OF CORRECTION

PATENT NO. : 6,860,798 B2
DATED : March 1, 2005
INVENTOR(S) : Terry Castor

It is certified that error appears in the above-identified patent and that said Letters Patent is hereby corrected as shown below:

Column 7,
Line 33, "mailer" should be -- matter --.

Signed and Sealed this

Twenty-third Day of August, 2005

JON W. DUDAS
*Director of the United States Patent and Trademark Office*